US011774083B2

(12) United States Patent
Zhang et al.

(10) Patent No.: US 11,774,083 B2
(45) Date of Patent: Oct. 3, 2023

(54) LIGHTING LAMP

(71) Applicant: Shenzhen Torshare Technology Co., Ltd., Guangdong (CN)

(72) Inventors: Houkun Zhang, Guangdong (CN); Mantie Li, Guangdong (CN); Liang Chen, Guangdong (CN); Jian Peng, Guangdong (CN); Huilong Zhang, Guangdong (CN)

(73) Assignee: Shenzhen Torshare Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/091,524

(22) Filed: Dec. 30, 2022

(65) Prior Publication Data

US 2023/0220982 A1 Jul. 13, 2023

(30) Foreign Application Priority Data

Jan. 13, 2022 (CN) ..... 202220089224.4

(51) Int. Cl.
*F21V 29/77* (2015.01)
*F21V 29/75* (2015.01)
*F21Y 105/18* (2016.01)

(52) U.S. Cl.
CPC ..... *F21V 29/75* (2015.01); *F21Y 2105/18* (2016.08)

(58) Field of Classification Search
CPC ..... F21V 29/77; F21V 29/773
See application file for complete search history.

(56) References Cited

U.S. PATENT DOCUMENTS

2013/0308314 A1* 11/2013 Wung ..... F21V 29/773 362/249.02
2016/0369995 A1* 12/2016 Jang ..... F21V 29/673

* cited by examiner

*Primary Examiner* — Sean P Gramling
(74) *Attorney, Agent, or Firm* — Chao Wei Chung

(57) ABSTRACT

The present disclosure discloses a lighting lamp including a casing, a heat dissipating plate, heat dissipating fins, a light source plate, a power supply and a light transmitting member. The heat dissipating plate is spaced from the casing to form an annular passage. The heat dissipating fins are spaced along a circumference of a back side of the heat dissipating plate. A portion of each heat dissipating fin is located within the annular passage. The light source plate and the light transmitting member are located on a front side of the heat dissipating plate in sequence. The power supply is located above the back side of the heat dissipating plate. Heat generated by the light source plate and the power supply is conducted to the annular passage and is then carried away by air flow in the annular passage. The lighting lamp has high structural strength and high heat dissipation efficiency.

18 Claims, 6 Drawing Sheets

LIGHTING LAMP

TECHNICAL FIELD

The present disclosure relates to a field of lighting, especially relates to a lighting lamp.

BACKGROUND

Mining lights, also known as high ceiling lights, are a kind of energy-efficient LED lamps, which can be widely used in industrial plants, production workshops, supermarkets, sports and entertainment venues, warehouses, and the like. In the existing technology, the mining light only uses fins for heat dissipation, but the fins does not fit well with the shell of the mining light, Therefore, the structural strength of the existing mining light is low and the heat dissipation effect of the existing mining light is poor.

SUMMARY

The present disclosure aims to solve, at least to some extent, one of the technical problems in the related technology. For this purpose, the present disclosure provides a lighting lamp, to solve the problem of low structural strength and poor heat dissipation of the mining light in the prior art.

To achieve the above purpose, the present disclosure provides a lighting lamp, including:

a casing having an inner hollow annular ring;

a heat dissipating plate being located within the annular ring of the casing; the heat dissipating plate being spaced from the casing to form an annular passage;

a plurality of heat dissipating fins being located on a back side of the heat dissipating plate and spaced along a circumference of the back side of the heat dissipating plate with a center of the heat dissipating plate; wherein each heat dissipating fin is coupled to an inner wall of the casing and to the back side of the heat dissipating plate; a portion of each heat dissipating fin close to the casing is located within the annular passage;

a light source plate being located on a front side of the heat dissipating plate;

a power supply being located above the back side of the heat dissipating plate and is spaced from the heat dissipating plate; and a light transmitting member being located on a side of the light source plate away from the heat dissipating plate;

wherein heat generated by the light source plate and the power supply is conducted by the heat dissipating fins to the portions of the heat dissipating fins located within the annular passage and is then carried away by air flow in the annular passage.

In at least one embodiment, a distance between the power supply and the back side of the heat dissipating plate is greater than a height of the heat dissipating fins.

In at least one embodiment, the lighting lamp further comprises at least one mounting post located on the back side of the heat dissipating plate, the power supply is mounted above the back side of the heat dissipating plate through the at least one mounting post.

In at least one embodiment, the lamp defines a through hole at a center of heat dissipating plate and a center of the light source plate.

In at least one embodiment, the at least one mounting post is located around the through hole.

In at least one embodiment, each mounting post is located between one of the plurality of heat dissipating fins and the through hole, and each mounting post is located on an extending direction of the one of the plurality of heat dissipating fins.

In at least one embodiment, each heat dissipating fin is progressively lower in height from one side of the heat dissipating fin away from the through hole to one side of the heat dissipating fin close to the through hole.

In at least one embodiment, the plurality of the heat dissipating fins comprises a plurality of long heat dissipating fins and a plurality of short heat dissipating fins; the plurality of the long heat dissipating fins and the plurality of the short heat dissipating fins are alternately located.

In at least one embodiment, ends of the heat dissipating fins close to the casing protrude from the casing in a height direction of the lighting lamp; each heat dissipating fin comprises a first part close to the casing and a second part close to the through hole; a height of the first part gradually increases from a side of the first part close to the casing to a side of the first part close to the through hole; a height of the second part gradually increases from a side of the second part close to the housing to a side of the second part close to the casing; the first part and the second part has a rounded transition connection at an intersecting position of the first part and the second part.

In at least one embodiment, an inclination of the first part is greater than an inclination of the second part.

In at least one embodiment, the heat dissipating fins and the heat dissipating plate are integrally formed.

In at least one embodiment, the heat dissipating fins and the casing are interconnected by means of snap connections.

In at least one embodiment, a back side of the heat dissipating plate is a corrugated thermal conductive surface; the corrugated thermal conductive surface comprises a plurality of protruded portions and a plurality of recessed portions alternatively; the protruded portions of the corrugated thermal conductive surface are connected to the heat dissipating fins; the light source plate comprises a light strip located on a side facing the light transmitting member; a projection of the protruded portions on the back side of the heat dissipating plate at least partially coincides with a projection of the light strip on the back side of the heat dissipating plate.

In at least one embodiment, the light strip is a plurality of light strip circles spreading from a center of the light source plate to an edge of the light source plate; the protruded portions is also a plurality of protruded circles spreading from a center of the heat dissipating plate to an edge of the heat dissipating plate.

In at least one embodiment, one side of the light transmitting member away from the light source plate protrudes outwardly; the light transmitting member comprises a plurality of tubular light transmitting rings uniformly arranged from a center of the light transmitting member diffusing outwardly; each light transmitting ring has a depression depth of 3 to 5 mm on the side close to the light source plate; each light transmitting ring has a radial width of 6.4 to 10 mm; a distance between midpoints of two adjacent light transmitting rings is 10 to 15 mm.

In at least one embodiment, the light transmitting member is a translucent plastic or semi-clear glass structure.

In at least one embodiment, the lighting lamp further comprises a fixing member provided on top of the power supply for fixing with outside.

In at least one embodiment, the lamp further comprises thermal conductive silicone grease located between the heat dissipating plate and the light source plate for enhancing thermal conductivity.

The beneficial effect of the present disclosure is as follows.

In the present disclosure, the annular passage is formed between the heat dissipating plate and the casing for air circulation. The annular passage has a vertical slope of the upward space, equivalent to a chimney, so that the air can flow from a bottom of the lighting lamp through the annular passage and flow out from the top of the lighting lamp. The heat generated by the light source plate and the power supply can be absorbed by the heat dissipating fins and conducted to the part of the heat dissipating fins located in the annular passage and is then carried away by the air flow in the annular passage, which enhances the air convection speed in the annular passage and speeds up the heat dissipation due to the chimney effect of the annular passage. Moreover, the heat dissipating fins and the heat dissipating plate are integrally formed, which helps to improve the overall structural strength.

BRIEF DESCRIPTION OF THE DRAWINGS

In order to more clearly illustrate the technical solution of the present disclosure, the following is a brief description of the attached drawings that need to be used in the description of the embodiment, it is obvious that the attached drawings in the following description are only some embodiments of the technical solution. For the person of ordinary skill in the art, other drawings can be obtained from the structure shown in these drawings without any creative effort.

Figure 1:
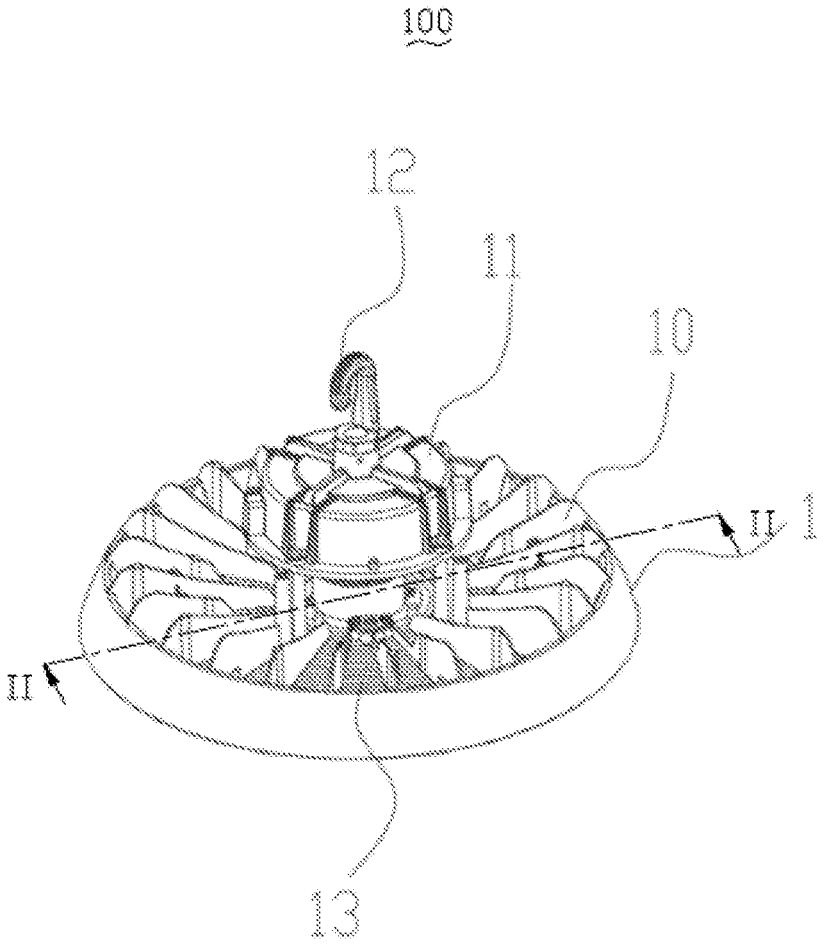
FIG. 1 is a schematic diagram of a lighting lamp according to one embodiment of the present disclosure.

DESCRIPTION OF THE ACCOMPANYING FIGURE MARKERS lighting lamp 100;
Casing 1, inner wall 101;
Heat dissipating fin 10, long heat dissipating fin 102, short heat dissipating fin 103;
Power supply 11, mounting post 111;
Fixing member 12;
Heat dissipating plate 13, front side 131, back side 132, protruded portion 1321, recessed portion 1322;
Light source plate 14, through hole 141, light strip 142;
Light transmitting member 15, light transmitting ring 16;
Annular passage 17.

DETAILED DESCRIPTION OF THE EMBODIMENTS

In order to make the purpose and the advantages of the technical solution more clearly understood, the following will be a clear and complete description of the technical solution with reference to the accompanying drawings in the embodiment of the technical solution. Obviously, the described embodiments are only parts of the embodiments of the technical solution, and not all of the embodiments.

Based on the embodiments in the technical solution, all other embodiments obtained by ordinary skill in the art without any creative work belong to the protection scope of the technical solution.

It should be noted that all directional indications (e.g. up, down, left, right, forward, backward . . . ) in the embodiments of the technical solution are only used to explain the relative position relationship, movement, etc. between the parts in a particular state (as shown in the attached figure), and if that particular posture changes, the directional indications are changed accordingly.

The descriptions such as "first" and "second" in the technical solutions are for descriptive purposes only, and are not to be understood as indicating or implying their relative importance or implicitly specifying the number of technical features indicated. Thus, the features qualified with "first" and "second" may explicitly or implicitly include at least one such feature.

In the description of the technical solution, "plurality" means at least two, such as two, three, etc., unless otherwise expressly and specifically limited.

In the technical solution, unless otherwise specified and limited, the terms "connection", "fixed", etc. should be understood in a broad sense, for example, "fixed" can be a fixed connection, for example, "fixed" may be a fixed connection, a removable connection, a one-piece molding; a mechanical connection or an electrical connection; a direct connection or an indirect connection through an intermediate medium; a connection within two components or an interaction between two components, unless otherwise expressly limited. For a person ordinary skill in the art, the specific meaning of the above terms in the technical solution can be understood according to the specific situation.

In addition, the technical solution between each embodiment of the technical solution can be combined with each other, but it must be based on the realization of the ordinary technical person in the field. When the combination of the technical solution appears contradictory or cannot be realized, it should be considered that such combination of the technical solution does not exist and is not within the protection scope required by the technical solution.

Embodiment 1

Figure 2:
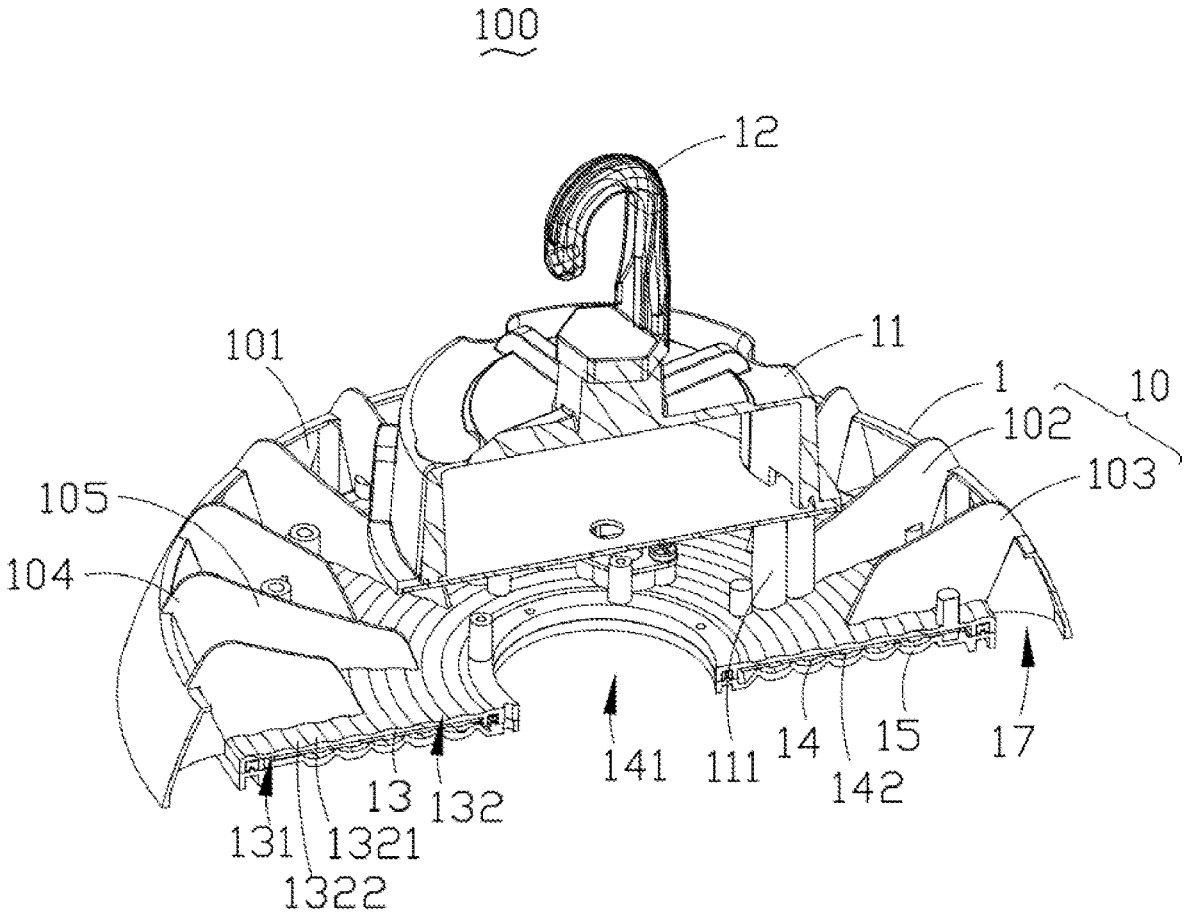
FIG. 2 is a cross-sectional view of FIG. 1 at II-II according to one embodiment of the present disclosure.
Figure 3:
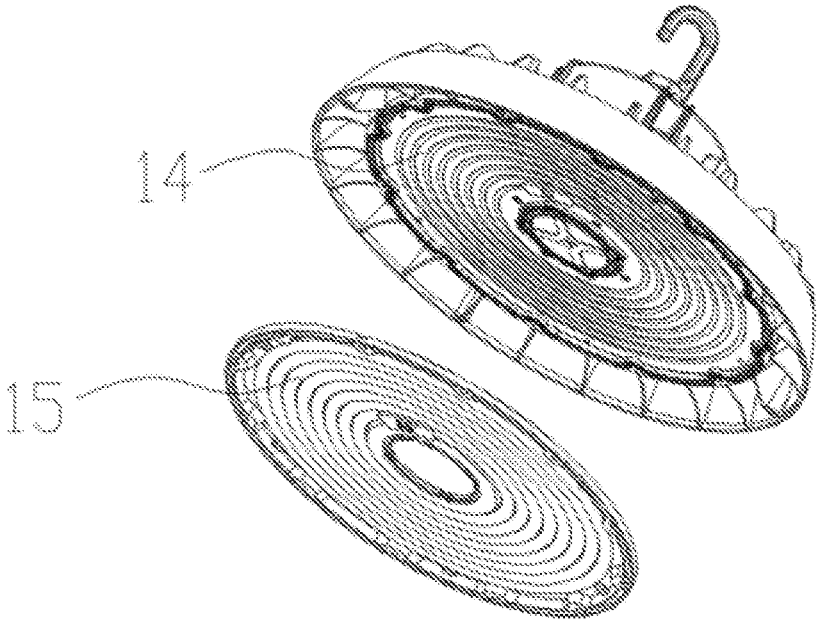
FIG. 3 is a schematic diagram of a light source plate and a light transmitting member according to one embodiment of the present disclosure.
Figure 4:
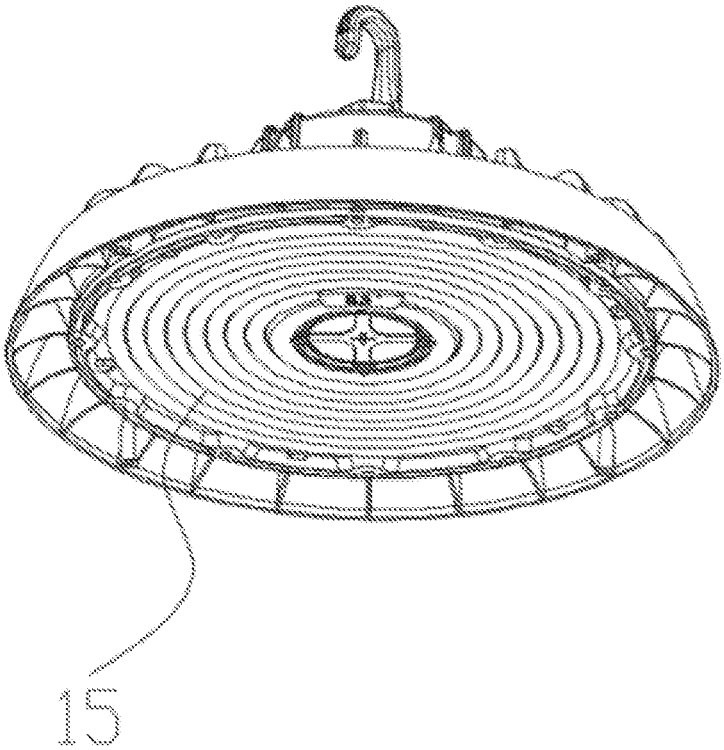
FIG. 4 is a schematic diagram of a setting position of the light transmitting member according to one embodiment of the present disclosure.
Figure 5:
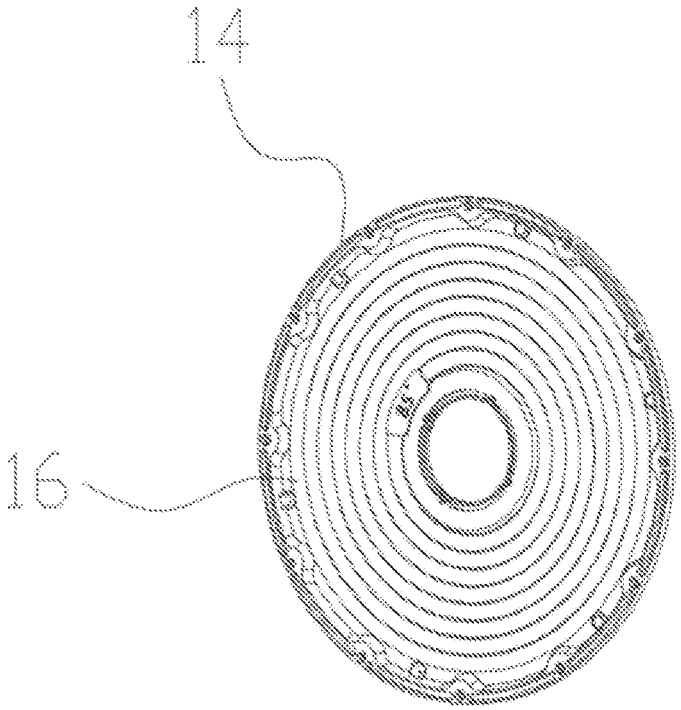
FIG. 5 is a structural schematic diagram of the light transmitting member and one surface of the light transmitting ring according to one embodiment of the present disclosure.
Figure 6:
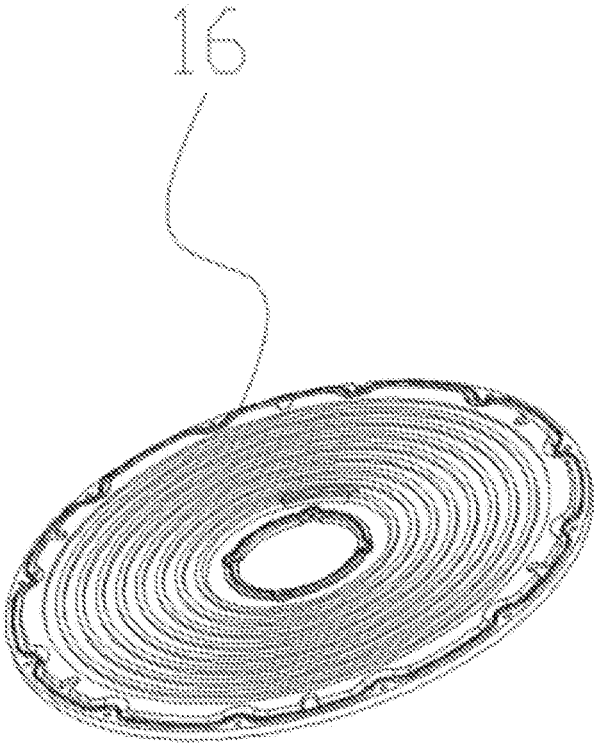
FIG. 6 is a structural schematic diagram of the other surface of the light transmitting ring according to one embodiment of the present disclosure.
Figure 7:
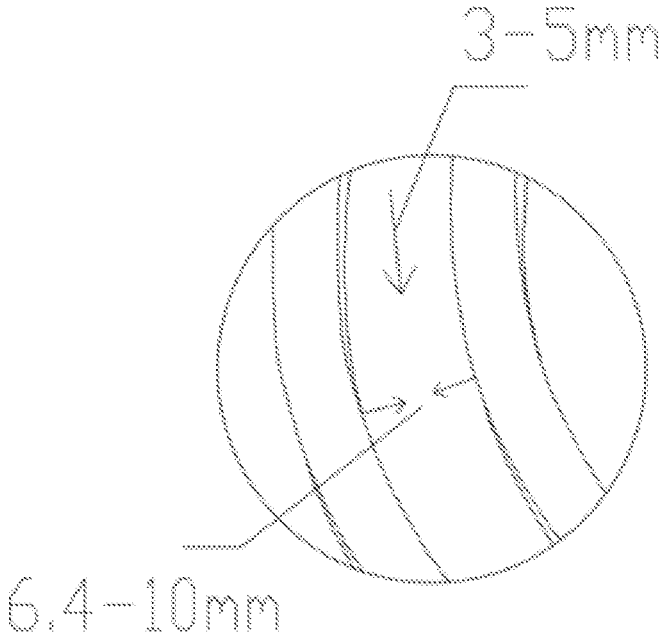
FIG. 7 is an enlarged view showing a recessed depth of the light transmitting ring and a radial width of the light transmitting ring according to one embodiment of the present disclosure.
Figure 8:
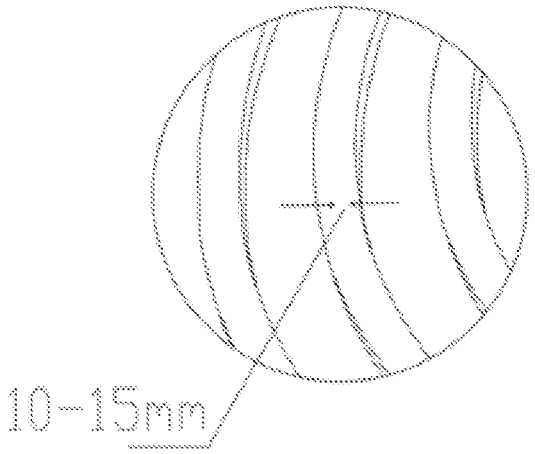
FIG. 8 is an enlarged view showing a distance between midpoints of two adjacent light transmitting rings according to one embodiment of the present disclosure.

Referring to FIGS. 1 and 2, FIG. 1 is a schematic diagram of a lighting lamp 100 according to one embodiment of the present disclosure; FIG. 2 is a cross-sectional view of FIG. 1 at II-II according to one embodiment of the present disclosure. FIG. 3 is a schematic diagram of a light source plate and a light transmitting member according to one embodiment of the present disclosure. The lighting lamp 100 includes a casing 1, a heat dissipating plate 13, a plurality of heat dissipating fins 10, a light source plate 14, a power supply 11 and a light transmitting member 15. The casing 1 is an inner hollow annular ring. An outer diameter of the heat dissipating plate 13 is smaller than an inner diameter of the casing 1. The heat dissipating plate 13 is located within an annular ring of the casing 1. The heat dissipating plate 13 is spaced from the casing 1 to form an annular passage 17. The plurality of heat dissipating fins 10 are spaced along a circumference of a back side 132 of the heat dissipating plate 13 with a center of the heat dissipating plate 13. Each heat dissipating fin 10 is connected to an inner wall 101 of the casing 1 and to the back side 132 of the heat dissipating plate 13. A part of each heat dissipating fin 10 close to the casing 1 is located within the annular passage 17, and extended to the inner wall 101 of the casing 1. The power supply 11 is located over the back side 132 of the heat dissipating plate 13 and is spaced apart from the heat dissipating plate 13. The light source plate 14 is located on a front side 131 of the heat dissipating plate 13. The light transmitting member 15 is located on one side of the light source plate 14 away from the heat dissipating plate 13. The heat generated by the light source plate 14 and the power supply 11 is conducted by the heat dissipating fins 10 to the portion of the heat dissipating fins 10 located within the annular passage 17 and is carried away by the air flow within the annular passage 17.

In this present disclosure, the annular passage 17 for air circulation is formed between the heat dissipating plate 13 and the casing 1. The annular passage 17 has an upward space with a vertical slope, equivalent to a chimney, and is thus able to use a chimney effect to allow air to flow from below the lighting lamp 100 through the annular passage 17 and out from above the annular passage 17. The heat generated by the light source plate 14 and power supply 11 is absorbed by the heat dissipating fins 10 and is then conducted by the heat dissipating fins 10 to the portion of the heat dissipating fins 10 located in the annular passage 17 and then carried away by the air flow in the annular passage 17. As the annular passage 17 is capable of forming a chimney effect, the air convection rate in the annular passage 17 is enhanced and heat dissipation is accelerated.

In some embodiments, a distance between the power supply 11 and the back side 132 of the heat dissipating plate 13 is greater than the height of the heat dissipating fins 10.

Therefore, a space between the power supply 11 and the back side 132 of the heat dissipating plate 13 allows air flow through. Furthermore, a distance between the power supply 11 and the back side 132 of the heat dissipating plate 13 is greater than the height of the heat dissipating fins 10, which can increase the air flow space between the power supply 11 and the back side 132 of the heat dissipating plate 13, and can thus export heat in the center of the lamp 100.

In some embodiments, the lamp 100 defines a through hole 141 at a center of the heat dissipating plate 13 and a center of the light source plate 14. The power supply 11 is located above the back side 132 of the heat dissipating plate 13 and facing the through hole 141.

Therefore, the flow of air from the front side 131 of the heat dissipating plate 13 to the back side 132 of the heat dissipating plate 13 through the through hole 141 can be achieved, the through hole 141 can reducing wind resistance and increasing the amount of flow from the front side 131 of the heat dissipating plate 13 to the back side 132 of the heat dissipating plate 13.

In some embodiments, the lighting lamp 100 further includes at least one mounting post 111 located on the back side 132 of the heat dissipating plate 13. The power supply 11 is mounted over the back side 132 of the heat dissipating plate 13 through the at least one mounting post 111. In this embodiment, the mounting posts 111 are four, four the mounting posts 111 are spaced. The power supply 11 is mounted over the back side 132 of the heat dissipating plate 13 through the four mounting posts 111. In other embodiments, the number of mounting posts 111 is not limited to four, but may also be less than four or more than four, without limitation.

Therefore, by means of the at least one mounting post 111, the height distance between the power supply 11 and the back side 132 of the heat dissipating plate 13 can increase. Since the size of the mounting posts 111 themselves are much smaller relative to the size of the power supply 11, the at least one mounting post 111 occupy less space on the heat dissipating plate 13 than the power supply 11, thus increasing the air flow space between the power supply 11 and the heat dissipating plate 13, which can reduce wind resistance and increase air flow space from a bottom of the heat dissipating plate 13 to a top of the heat dissipating plate 13 through the through hole 141, further improving the heat dissipation effect.

In some embodiments, the at least one mounting post 111 is located around the through hole 141. In this embodiment, the mounting posts 111 are four, four the mounting posts 111 are spaced around the through hole 141. In other embodiments, the number of mounting posts 111 is not limited to four, but may also be less than four or more than four, without limitation.

In some embodiments, each mounting post 111 is located between one of the plurality of heat dissipating fins 10 and the through hole 141, and each mounting post 111 is located on an extending direction of the one of the plurality of heat dissipating fins 10.

Therefore, the mounting posts 111 do not block air flow paths between the heat dissipating fins 10 and do not increase additional air resistance.

In some embodiments, each heat dissipating fin 10 is progressively lower in height from one side away from the through hole 141 to another side close to the through hole 141, i.e. a wave-funnel type heat dissipating fin.

Therefore, the use of the wave-funnel type heat dissipating fin 10 can further increase the air flow space between the power supply 11 and the back side 132 of the heat dissipating plate 13, which can further reduce wind resistance and increase air flow from the bottom of the heat dissipating plate 13 to the top of the heat dissipating plate 13 via the through hole 141, leaving enough passage space for hot air convection, and exporting the heat at the center of lighting lamp 100 outwardly well, and to dissipate heat better than other lamps of the similar type.

In some embodiments, the plurality of heat dissipating fins 10 have different lengths in the radial direction of the heat dissipating plate 13, specifically including a plurality of long heat dissipating fins 102 and a plurality of short heat dissipating fins 103. The long heat dissipating fins 102 and short heat dissipating fins 103 are alternately located on the back side 132 of the heat dissipating plate 13. A length of the short heat dissipating fin 103 in the radial direction of the heat dissipating plate 13 is 2/1 to 2/3 of the length of the long heat dissipating fin 102 in the radial direction of the heat dissipating plate 13.

Therefore, since the lighting lamp 100 is circular in overall shape and the plurality of heat dissipating fins 10 are spaced along the circumference of the back side 132 of the heat dissipating plate 13 with the center of the heat dissipating plate 13; the distance between two adjacent heat dissipating fins 10 gradually decreases from the side away from the center of the heat dissipating plate 13 to the side close to the center of the heat dissipating plate 13. Thus, the long heat dissipating fins 102 and the short heat dissipating fins 103 are alternately located to increase the air flow space on the side close to the center of the heat dissipating plate 13, which helps to heat dissipation, while achieving a weight reduction effect, lowering the amount of material used and reducing costs.

In some embodiments, each mounting post 111 is located on an extending direction of the short heat dissipating fin 103 towards the through hole 141, thus, i.e. not affecting the heat dissipation and not affecting the arrangement space of the long heat dissipating fins 102.

In some embodiments, the casing 1 is an inner hollow conical ring, i.e., in a form of an opening with a small top end and a large bottom end, and the end of the heat dissipating fins 10 close to the casing 1 protrudes from the casing 1 in a height direction of the lighting lamp 100; the heat dissipating fins 10 have different heights in the radial direction of the heat dissipating plate 13. Furthermore, a portion of the heat dissipating fin 10 having a maximum value height is not the end connected to the casing 1. Each heat dissipating fin 10 includes a first part 104 close to the casing 1 and a second part 105 close to the through hole 141. A height of the first part 104 gradually increases from a side of the first part 104 close to the casing 1 to a side of the first part 104 close to the through hole 141. A height of the second part 105 gradually increases from a side of the second part 105 close to the housing to a side of the second part 105 close to the casing 1; the first part 104 and the second part 105 has a rounded transition connection at an intersecting position of the first part 104 and the second part 105.

In some embodiments, an inclination of the first part 104 is greater than an inclination of the second part 105.

Therefore, compared to the lighting lamp 100 in which the heat dissipating fin 10 does not protrude from the casing 1, the heat dissipating fins 10 close to the casing 1 of the present disclosure protrudes from the casing 1 in a height direction of the lighting lamp 100, increasing the height of the heat dissipating fins 10, thereby increasing the overall structural strength of the lighting lamp 100 by improving the structural strength of the heat dissipating fin 10 itself. The overall structural strength of the lighting lamp 100 is increased by improving the structural strength of the heat dissipating fins 10 themselves, eliminating the need for additional auxiliary structural strength components and allowing for lower production costs and weight reduction while still meeting the structural strength.

In some embodiments, the heat dissipating fin 10 is a copper structure attached to the back side 132 of the heat dissipating plate 13 by welding. In other embodiments, the heat dissipating fins 10 and the heat dissipating plate 13 may also be made of same materials by extruding aluminum into the die-cast.

In some embodiments, the heat dissipating fins 10 and the casing 1 are interconnected by means of snap connections.

In some embodiments, the heat dissipating plate 13 itself has thermal conductivity.

In some embodiments, a receiving space for receiving the light source plate 14 is formed between the light transmitting member 15 and the heat dissipating plate 13. The light source plate 14 is received in the receiving space.

In some embodiments, a back side of the heat dissipating plate 13 is a corrugated thermal conductive surface; the corrugated thermal conductive surface includes a plurality of protruded portions 1321 and a plurality of recessed portions 1322 alternatively; the protruded portions 1321 of the corrugated thermal conductive surface are connected to the heat dissipating fins 10; the light source plate 14 may includes a light strip 142 located on a side facing the light transmitting member 15; the light strip 142 may be an LED strip. A projection of the protruded portions 1321 on the back side 132 of the heat dissipating plate 13 at least partially coincides with a projection of the light strip 142 on the back side 132 of the heat dissipating plate 13. In this embodiment, the projection of the protruded portions 1321 on the back side 132 of the heat dissipating plate 13 is located in the projection of the light strip 142 on the backside 132 of the heat dissipating plate 13.

Therefore, the protruded portions 1321 are connected to the heat dissipating fins 10 respectively. By means of the protruded portions 1321, the heat generated by the light strip 142 at the corresponding positions can be more quickly conducted away to meet the heat dissipation requirements. Moreover, the demand for heat conduction of the light strip 142 is satisfied by the protruded portions 1321, and the portions other than the protruded portions 1321 are thinned to form recessed portions 1322, for the purpose of overall weight reduction and reduction of production cost, so as to satisfy heat conduction requirements.

In some embodiments, the light strip 142 includes a plurality of light strip circles spreading from a center of the light source plate 14 to an edge of the light source plate 14. The protruded portions 1321 is also a plurality of protruded circles spreading from a center of the heat dissipating plate 13 to an edge of the heat dissipating plate 13.

Therefore, each light strip circle is provided in correspondence with a protruded circle so that each light strip circle can have sufficient heat dissipation.

In some embodiments, the light transmitting member 15 is a translucent plastic or semi-clear glass structure. Referring together to FIGS. 4 to 8, one side of the light transmitting member 15 away from the light source plate 14 projects outwardly. The light transmitting member 15 comprises a plurality of tubular light transmitting rings 16 uniformly arranged from a center of the light transmitting member 15 diffusing outwardly; each light transmitting ring 16 has a depression depth of 3 to 5 mm on the side close to the light source plate 14 each light transmitting ring 16 has a radial width of 6.4 to 10 mm. A distance between midpoints of two adjacent light transmitting rings 16 is 10 to 15 mm.

Thus, the light transmitting member 15 with the above parameters of the light transmitting ring 16 makes the UGR glare value of the lighting lamp 100 having a light emitting angle 60~110 degrees is less than 28, and the UGR glare value of the 110 degree emitting angle of other lamps of the similar type on the market cannot be less than 28. The UGR glare value of the 60~110 degree emitting angle of present disclosure is less than 28, which satisfies premium energy efficiency requirements of DLC5.1Premium, and can reduce the glare value.

In some embodiments, please refer again to FIG. 1, the lighting lamp 100 also includes a fixing member 12 set on top of the power supply 11 for external fixing. The lighting lamp 100 is fixed by the fixing member 12.

Referring to FIG. 1, preferably, the heat dissipating plate 13 further includes thermal conductive silicone grease located between the heat dissipating plate 13 and the light source plate 14 for enhancing thermal conductivity.

The working principle of the technical solution is as follows.

With the wave-funnel type heat dissipating fin (lower inside and higher outside), it can export the central heat outward well, which is better than other lighting lamps of the similar type in terms of heat dissipation. By setting the specific depth, width and other parameters of the light transmitting ring 16, the UGR glare value of the lighting lamp 100 at the luminous angle of 60 to 110 degrees are less than 28.

In addition, this application can achieve UGR glare value less than 28 and meet the energy efficiency requirements of DLC5.1Premium, and is compatible with power and color temperature adjustment, and is also compatible with plug-in sensors (microwave, infrared, Bluetooth, etc.) to achieve intelligent control.

The above mentioned is only the preferred embodiment of the technical solution, not to limit the patent scope of the technical solution, all the equivalent structural transformation made by using the technical solution specification and the attached drawings under the technical solution concept, or directly/indirectly applied in other related technical fields are included in the protection scope of the technical solution.

What is claimed is:

1. A lighting lamp comprising:

a casing having an inner hollow annular ring;

a heat dissipating plate being located within the annular ring of the casing, the heat dissipating plate being spaced from the casing to form an annular passage;

a plurality of heat dissipating fins being located on a back side of the heat dissipating plate and spaced along a circumference of the back side of the heat dissipating plate with a center of the heat dissipating plate; wherein each heat dissipating fin is coupled to an inner wall of the casing and to the back side of the heat dissipating plate; a portion of each heat dissipating fin close to the casing is located within the annular passage;

a light source plate being located on a front side of the heat dissipating plate;

a power supply being located above the back side of the heat dissipating plate and is spaced from the heat dissipating plate; and a light transmitting member being located on a side of the light source plate away from the heat dissipating plate;

wherein heat generated by the light source plate and the power supply is conducted by the heat dissipating fins to the portions of the heat dissipating fins located within the annular passage and is then carried away by air flow in the annular passage;

wherein a back side of the heat dissipating plate is a corrugated thermal conductive surface; the corrugated thermal conductive surface comprises a plurality of protruded portions and a plurality of recessed portions alternatively; the protruded portions of the corrugated thermal conductive surface are connected to the heat dissipating fins; the light source plate comprises a light strip located on a side facing the light transmitting member; a projection of the protruded portions on the back side of the heat dissipating plate at least partially coincides with a projection of the light strip on the back side of the heat dissipating plate.

2. The lighting lamp according to claim 1, wherein a distance between the power supply and the back side of the heat dissipating plate is greater than a height of the heat dissipating fins.

3. The lighting lamp according to claim 2, wherein the lighting lamp further comprises at least one mounting post located on the back side of the heat dissipating plate, the power supply is mounted above the back side of the heat dissipating plate through the at least one mounting post.

4. The lighting lamp according to claim 3, wherein the lamp defines a through hole at a center of heat dissipating plate and a center of the light source plate.

5. The lighting lamp according to claim 4, wherein the at least one mounting post is located around the through hole.

6. The lighting lamp according to claim 4, wherein each mounting post is located between one of the plurality of heat dissipating fins and the through hole, and each mounting post is located on an extending direction of the one of the plurality of heat dissipating fins.

7. The lighting lamp according to claim 4, wherein each heat dissipating fin is progressively lower in height from one side of the heat dissipating fin away from the through hole to one side of the heat dissipating fin close to the through hole.

8. The lighting lamp according to claim 1, wherein the plurality of the heat dissipating fins comprises a plurality of long heat dissipating fins and a plurality of short heat dissipating fins; the plurality of the long heat dissipating fins and the plurality of the short heat dissipating fins are alternately located.

9. The lighting lamp according to claim 1, wherein the lamp defines a through hole at a center of heat dissipating plate and a center of the light source plate; ends of the heat dissipating fins close to the casing protrude from the casing in a height direction of the lighting lamp; each heat dissipating fin comprises a first part close to the casing and a second part close to the through hole; a height of the first part gradually increases from a side of the first part close to the casing to a side of the first part close to the through hole; a height of the second part gradually increases from a side of the second part close to the casing to a side of the second part close to the casing; the first part and the second part has a rounded transition connection at an intersecting position of the first part and the second part.

10. The lighting lamp according to claim 9, wherein an inclination of the first part is greater than an inclination of the second part.

11. The lighting lamp according to claim 1, wherein the heat dissipating fins and the heat dissipating plate are integrally formed.

12. The lighting lamp according to claim 1, wherein the heat dissipating fins and the casing are interconnected by means of snap connections.

13. The lighting lamp according to claim 1, wherein the light strip is a plurality of light strip circles spreading from a center of the light source plate to an edge of the light source plate; the protruded portions is also a plurality of protruded circles spreading from a center of the heat dissipating plate to an edge of the heat dissipating plate.

14. The lighting lamp according to claim 1, wherein one side of the light transmitting member away from the light source plate protrudes outwardly; the light transmitting member comprises a plurality of tubular light transmitting rings uniformly arranged from a center of the light transmitting member diffusing outwardly; each light transmitting ring has a depression depth of 3 to 5 mm on the side close to the light source plate; each light transmitting ring has a radial width of 6.4 to 10 mm; a distance between midpoints of two adjacent light transmitting rings is 10 to 15 mm.

15. The lighting lamp according to claim 1, wherein the light transmitting member is a translucent plastic or semi-clear glass structure.

16. The lighting lamp according to claim 1, wherein the lighting lamp further comprises a fixing member provided on top of the power supply for fixing with outside.

17. The lighting lamp according to claim 1, wherein the lamp further comprises thermal conductive silicone grease located between the heat dissipating plate and the light source plate for enhancing thermal conductivity.

18. A lighting lamp comprising:

a casing having an inner hollow annular ring;

a heat dissipating plate being located within the annular ring of the casing, wherein the heat dissipating plate is spaced from the casing to form an annular passage;

a plurality of heat dissipating fins being located on a back side of the heat dissipating plate and spaced along a circumference of the back side of the heat dissipating plate with a center of the heat dissipating plate; wherein each heat dissipating fin is coupled to an inner wall of the casing and to the back side of the heat dissipating plate; a portion of each heat dissipating fin close to the casing is located within the annular passage;

a light source plate being located on a front side of the heat dissipating plate;

a power supply being located above the back side of the heat dissipating plate and is spaced from the heat dissipating plate; and a light transmitting member being located on a side of the light source plate away from the heat dissipating plate;

wherein heat generated by the light source plate and the power supply is conducted by the heat dissipating fins to the portions of the heat dissipating fins located within the annular passage and is then carried away by air flow in the annular passage;

wherein one side of the light transmitting member away from the light source plate protrudes outwardly; the light transmitting member comprises a plurality of tubular light transmitting rings uniformly arranged from a center of the light transmitting member diffusing outwardly; each light transmitting ring has a depression depth of 3 to 5 mm on the side close to the light source plate; each light transmitting ring has a radial width of 6.4 to 10 mm; a distance between midpoints of two adjacent light transmitting rings is 10 to 15 mm.

* * * * *